United States Patent [19]

Bone

[11] Patent Number: 5,074,452

[45] Date of Patent: Dec. 24, 1991

[54] VARIABLE PITCH FEED OF FASTENERS

[75] Inventor: Arnold R. Bone, Needham, Mass.

[73] Assignee: Dennison Manufacturing Company, Framingham, Mass.

[21] Appl. No.: 633,232

[22] Filed: Dec. 21, 1990

[51] Int. Cl.[5] ..... B25C 1/00

[52] U.S. Cl. ..... 227/67; 226/67

[58] Field of Search ..... 227/67; 226/67, 55

[56] References Cited

U.S. PATENT DOCUMENTS

| | | | |
|---|---|---|---|
| 4,310,962 | 1/1982 | Suzuki | 227/67 |
| 4,402,446 | 9/1983 | Suzuki | 227/67 |
| 4,482,087 | 11/1984 | Furutsu | 227/67 |
| 4,485,954 | 12/1984 | Furutsu | 227/67 |
| 4,553,688 | 11/1985 | Furutsu | 227/67 |
| 4,651,913 | 3/1987 | Bone | 227/67 |

*Primary Examiner*—Frank T. Yost
*Assistant Examiner*—Scott A. Smith
*Attorney, Agent, or Firm*—Arthur B. Moore

[57] ABSTRACT

A tag attaching gun in which an ejector rod is advanced by a trigger operated lever to sever an individual fastener from a fastener assemblage and dispense the severed fastener through a hollow slotted needle. This apparatus incorporates a unitary, single-tooth feed member for advancing the fastener assemblage to bring the forwardmost fastener in line with the needle. Such feed member comprises a reciprocably mounted body integral with a U-shaped resilient finger terminating in a feed tooth. The feed member together with its resilient feed finger moves linearly in order to engage and advance the fastener assemblage, while the finger flexes during a return motion in order to clear a succeeding fastener in the assemblage.

10 Claims, 6 Drawing Sheets

FIG. 4c
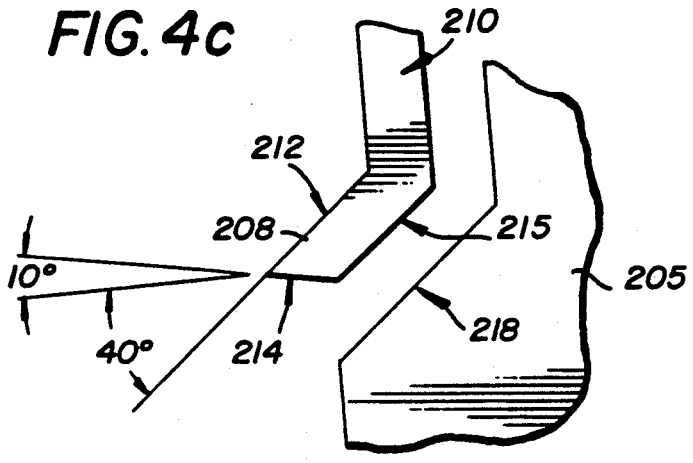
FIG. 4b
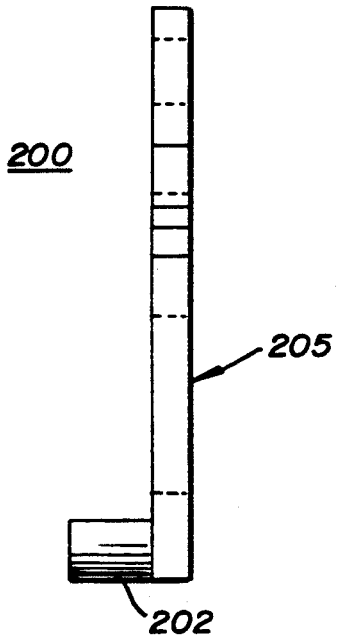
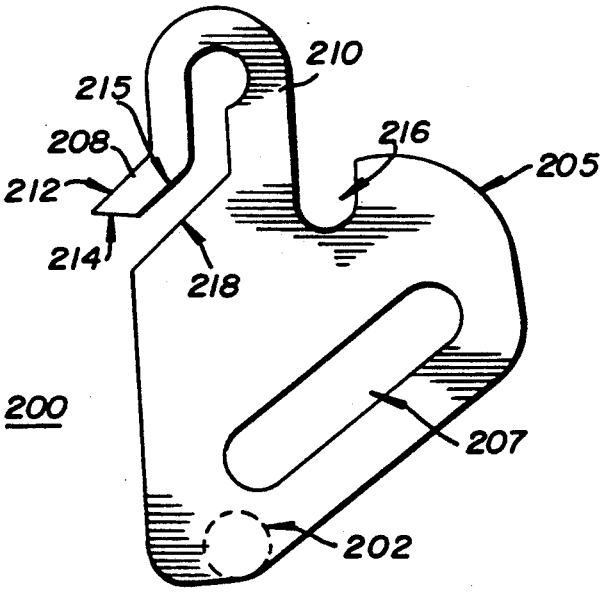
FIG. 4a

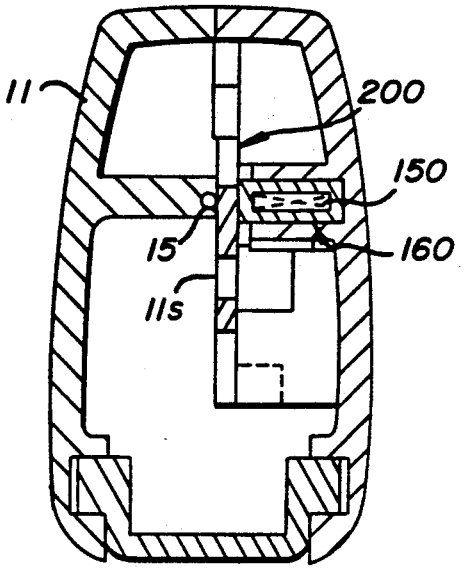
FIG. 10
FIG. 7
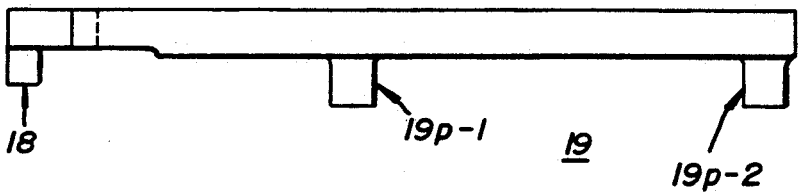

VARIABLE PITCH FEED OF FASTENERS

SPECIFICATION

This invention relates to the feed of fasteners, and more particularly to the variable pitch feed of fasteners.

A common fastener for tagging or attaching items is of the kind shown and described, for example, in U.S. Pat. No. 3,380,122. The fasteners (sometimes called "tag pins") are in an assemblage including a connecting bar, a plurality of coplanar connecting stubs extending from the connecting bar, a cross bar angularly disposed on each stub, a filament extending from each cross bar, and typically, a head attached to each filament. Common fastener attaching apparatus, such as is shown and described for example in U.S. Pat. No. 4,416,407 are designed to install fasteners disposed at a unique distance, relative to each other, on the connecting bar. Typically, a feed wheel is provided having circumferential teeth which mate with the assemblage stubs, operable to advance the assemblage in the apparatus. The number and pitch of the feed wheel teeth correspond to the pitch, or relative separation, of fasteners on the assemblage. However, fasteners are provided in varieties for which it is common practice to have a different fastener dispensing apparatus for each variation.

Accordingly, various attempts have been made to provide for feeding in a single apparatus of different assemblages, each having a unique pitch. U.S. Pat. No. 4,310,962 shows a fastener installation apparatus including a feed member having cooperative feeding and anti-back-up members. In one embodiment, an advance mechanism includes a U-shaped rod, the rod ends engagable with an installed fastener assemblage. In an alternative embodiment, two rods engage the assemblage. In each embodiment, an upper rod acts to advance the assemblage, and a lower rod serves to prevent upward movement of the assemblage during feeding. Both rods may bend in either direction; however, each rod end is provided with an angled upper surface so that downwards movement of the assemblage is favored. The feeding strength of this apparatus is limited by the resiliency, or biasing strength, of the upper rod. As the strength of the upper rod is increased, so too must the strength of the lower rod be increased; otherwise, the assemblage will back-up as the upper rod is urged upwardly. As a result, advancing strength is dissipated by the lower rod. Thus only a small advancing force can be generated by this design. Therefore this apparatus is vulnerable to misfeeding and jamming, particularly where the assemblage fails to slide smoothly within the guide grooves of the apparatus.

U.S. Pat. No. 4,461,417 shows an apparatus designed to install fastener assemblages of varying pitch. A claw is pivotally mounted to a vertically moveable cam plate, the claw being biased in the direction of the connecting bar. A stationary claw with downwardly angled teeth is provided for the purpose of preventing upward movement of the connecting bar during feeding, and is located on the side of the connecting bar opposite the moveable claw. In operation, the cam plate is raised, causing the moveable claw to be dragged upwardly along the connecting bar. When the trigger is released the cam plate is lowered, wherein the moveable claw, or in an alternative embodiment, the teeth engages the connecting bar and urges the assemblage downwardly. Since the claw is not drawn away from the connecting bar, an upwards force is exerted upon the connecting bar. A disadvantage to this design resides in the pivotal arrangement of the claw. As the cam plate is raised, the claw is pressed with continually greater force against the connecting bar, raising the potential for a jam. As the cam plate is lowered, the claw does not contact the connecting bar until the claw has pivoted into position, thus the connecting bar may not be advanced sufficiently to position the next fastener for ejection. Additionally, the design depends on the claw or teeth cutting into the connecting bar in order to advance the fastener assemblage. Since fastener assemblages are fabricated from a wide variety of materials, there exists the possibility that the claw will either imbed itself too deeply into the connecting bar, causing a jam, or will fail to engage, resulting in a misfeed.

In a third approach, taken in U.S. Pat. No. 4,465,218, a tooth is movably mounted within a pivotable base. The tooth is biased in the direction of the assemblage, pivoting on a pin. To prevent the tooth from overextending, a pin extends from the base into an aperture located near the tooth. When the trigger is depressed, the base pivots urging the tooth upwards. The tooth is caused to pivot, deflecting around the next stem. When the trigger is released the tooth engages the stem and urges the assemblage downwards. One disadvantage of this design is that all of the advancing and biasing force is exerted upon a small pivot pin which is subject to wear and breakage. Another disadvantage is that the design requires two carefully mated parts which must be assembled, thus raising the cost of the apparatus.

To prevent back-up of the assemblage during feed, the '218 patent provides a tooth biased in the direction of the assemblage, to engage the connecting stubs. The tooth has an upper profile disposed at an angle to the axis of the assemblage, thus permitting downwards movement A lower profile is disposed perpendicular to the axis of the assemblage, thus preventing upward movement of same. A problem with this design is that the device provides for only a fixed stub thickness. A thicker stub would not fit beneath the lower profile. A thinner stub could move up or down below the lower profile. As a result, the push rod, or plunger, may not squarely engage the cross bar, and thus jamming can arise. Additionally, this design does not permit the fastener assemblage to be withdrawn without additional devices for retracting the anti-back-up member.

U.S. Pat. Nos. 4,538,754; 4,456,162; 4,482,087; and 4,553,688 disclose other tag attacher designs accommodating variable inter-fastener pitches of a tag pin assemblage. All of these designs include a cam plate which is mounted adjacent the guide bore through which the tag pin assemblage is fed. The cam plate reciprocates parallel to the axis of tag pin assemblage feed. In the design of U.S. Pat. No. 4,538,754, the cam plate has an inclined lower edge which intermittently engages an indexing slide in turn linked to the trigger, as known in other designs. The indexing slide is intermittently driven by the trigger-actuator linkages to cause the moveable plate to ascend and descend. A "feeder element" is pivotally mounted on the moveable plate and is formed with a claw part to bite into and advance the connecting necks (stubs) of the tag pin assemblage, the claw part being rockable to avoid interference during upward (return) motion of the cam plate.

In U.S. Pat. No. 4,456,162 a "locking member" is pivotally mounted to the cam plate, and has projections which contact opposite surfaces of a connecting bar in the tag pin assemblage so as to force the assemblage downwardly within the guide bore. The engagement occurs via a press-twisting action exerted by the projections on the locking member.

Still another variable pitch tag attacher design involving a reciprocable cam plate is disclosed in U.S. Pat. No. 4,482,087. An engaging pawl having a sharp front end is pivotally mounted to the cam plate and positively engages the connecting bar of the tag pin assemblage to advance the assemblage within the guide bore. The cam plate has a tapered lower surface which abuts against a mating surface of the indexing slide which overcomes a downward bias. The engaging pawl member is to a spring holding pin in a groove of the cam plate thereby biasing the engaging pawl member toward the tag pin assemblage.

The tag attacher of U.S. Pat. No. 4,553,688 incorporates the tag pin feed mechanism of U.S. Pat. No. 4,482,087, discussed above, and in addition includes a "stopper" having a ratchet, pushing blade, and shaft. This stopper, deployed on the other side of the tag pin assemblage from the feed mechanism, prevents retrograde motion of the tag pin assembly.

Commonly assigned U.S. Pat. No. 4,651,913 discloses another fastener dispensing tool which permits variable pitch feed of fasteners; the disclosure of this patent is incorporated by reference herein. With reference to FIGS. 2 and 4 of the '913 patent, the tool includes a feed member comprising a pivot pin, link aperture and finger having a tooth. The feed member has a fixed pivot point relative to the frame. An aperture in the feed member couples to a linking rod. The finger has a curved profile, and is integrally formed from the feed member body. The apparatus frame is provided with a curved ridge matable with the curved profile of the finger which supports the finger as it engages the fastener assemblage. The tooth has an upper surface defining an angle with respect to the axis of the installed assemblage, when the feed member is in an advanced position, and a lower surface approximately perpendicular to the axis of the assemblage.

To prevent the fastener assemblage from moving upwards during cycling of the feed member, an anti-back-up member is provided, as shown in FIGS. 3, 5, and 9 of U.S. Pat. No. 4,651,913.

It is a principal object of the invention to provide reliable variable pitch fastener installation apparatus. Such apparatus should securely position fasteners to be ejected, while simultaneously preventing unwanted back-up of the assemblage during feeding.

SUMMARY OF THE INVENTION

In accomplishing the foregoing and related objects, the invention provides a variable pitch fastener dispensing apparatus incorporating a unitary, single-toothed feed member which is reciprocably mounted within said apparatus to engage and advance a fastener assemblage. This advancing motion brings the forwardmost fastener within the fastener assemblage in-line with a hollow, slotted needle where such fastener is engaged by an ejector rod, severed, and dispensed through the hollow slotted needle. The unitary, single-toothed feed member comprises a body integral with a resilient feed finger terminating in a tooth. The feed member is reciprocably mounted within the tag attaching apparatus to move in proximity with and parallel to a guide groove which houses the fastener assemblage.

In accordance with one aspect of the invention, the elements of the invention cooperate with existing fastener installation apparatus mechanisms of the type including a trigger, actuator lever, and an ejector rod cooperative with the trigger and lever via a slide, such as is shown and described for example in U.S. Pat. No. 4,416,407. A second, indexing slide is intermittently reciproacted by the trigger and actuator lever, and in turn reciprocates the feed member. Preferably, the indexing slide is coupled to the feed member via a pin at one end of the slide, which fits in an angled cam slot in the feed member.

In accordance with another aspect of the invention, the resilient feed finger comprises a generally "U" shaped structure one end of which is joined to the upper end of the body of the feed member, and the other end of which comprises the tooth. Other retroflex shapes of the feed finger (i.e., shapes wherein the feed finger bends back toward the feed member) may also be employed. Advantageously, the "U" shaped resilient feed finger is supported by a complementary cavity in the frame of said fastener installation apparatus. The feed finger is surrounded by the walls of said cavity when the feed member approaches its upwardmost position, with sufficient clearance to permit the feed finger to slide within the cavity. Preferably, the feed member is planar in form, and the dimensions and support of the resilient feed finger are such as to confine its flexure substantially within the plane of the feed member.

In the preferred embodiment of the invention, the tag dispensing gun incorporates a camming surface which cooperates with an angled upward surface of the feed tooth to urge the flexible feed finger and tooth to an out-of-the-way position as the feed member moves towards its uppermost position within the apparatus. Therefore, the operator may fully depress the trigger in order to disengage the feed tooth from the fastener assemblage and allow the assemblage to be conveniently removed from the apparatus.

A tooth is disposed about the end of the finger, positionable between stubs of an installed fastener assemblage. A tooth has an angled upper surface, and a lower surface defining a plane substantially parallel to the axis of the crossbar of an engaged fastener. As the trigger is depressed, the feed member reciprocates upwardly within the apparatus, whereby the resilient feed finger bends to permit the tooth to ride over the stub of the next fastener to be advanced. When the finger is released, the tooth engages the upper surface of the stub and urges the assemblage downwards, positioning the fastener for ejection. During this fastener-advancing motion, the feed member including the feed finger moves in a substantially linear manner.

BRIEF DESCRIPTION OF THE DRAWINGS

The above and other aspects of the invention will become apparent in considering an illustrative embodiment taken in conjunction with the accompanying drawings, in which:

FIGS. 4a and 4b are front and side views of the feed member of FIG. 2, and FIG. 4c is a detailed view of the tooth;

FIG. 7 is a side view of the indexing slide;

FIG. 10 is a front sectional view taken along the section 10—10 from FIG. 2, a central point of the feed and locating members.

DETAILED DESCRIPTION OF THE INVENTION

Figure 1:
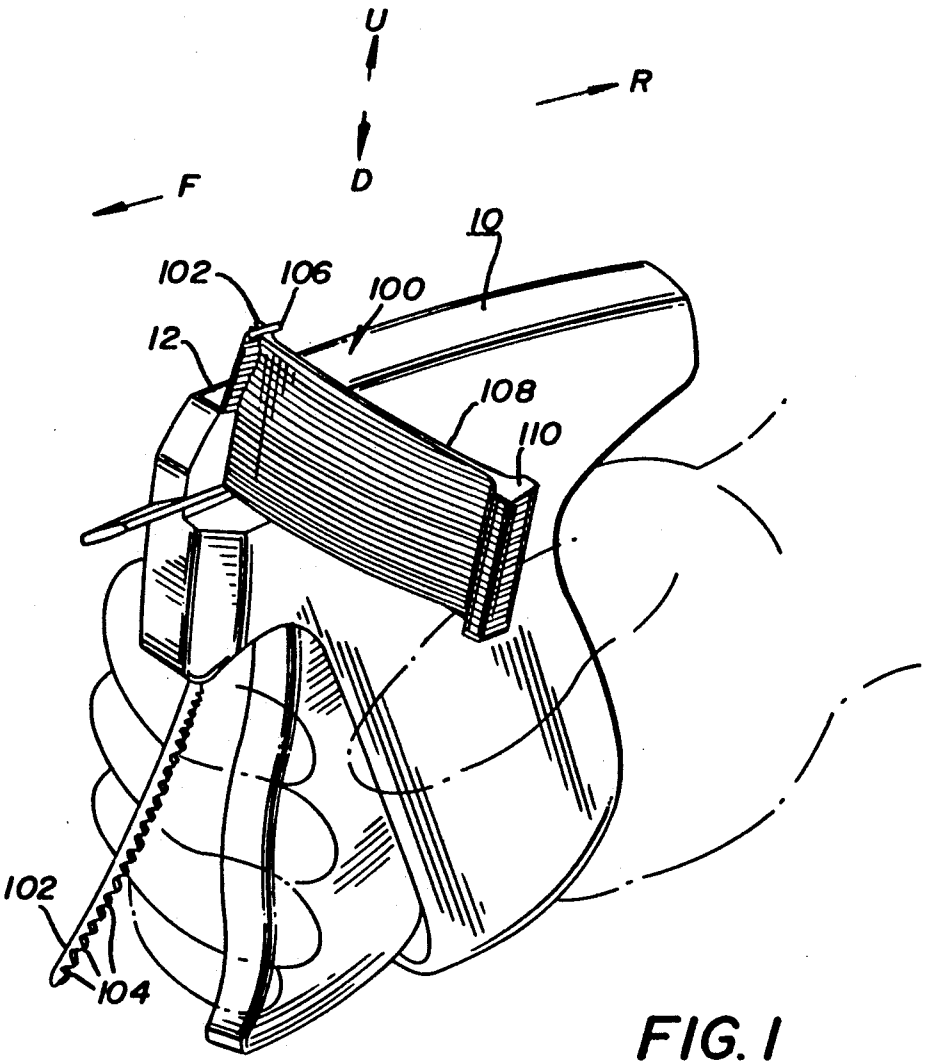
FIG. 1 is a perspective view of an installation apparatus in accordance with the invention, with a fastener assemblage installed.

With reference to 1-3, the present invention provides a fastener dispensing apparatus, or gun 10, having a variable pitch feed member 200, and a location member 300. Elements 200 and 300 cooperate to provide for reliable advance of a variety of fastener assemblages. As can be seen in FIG. 1, the fastener apparatus 10 of the invention receives a fastener assemblage 100 in a guide groove 12 disposed at the front of the apparatus. Assemblage 100 comprises a connecting bar 102; a plurality of coplanar stubs 104; a crossbar 106 perpendicularly disposed about the end of each stub 104; a filament 108 extending from each crossbar 106; and typically, a head portion 110 disposed about the end of each filament. The distance between stubs 104 represents the "pitch" of the assemblage. It has become increasingly common for fasteners to be disposed at a closer pitch on the connecting bar, thereby reducing the mold size and lower cost, as well as providing for less frequent loading. However, prior fastener assemblages exist in great quantity. Therefore, there exists a variety of different pitch fastener assemblages, typically ranging from about 0.045" to 0.080" (1.14–2.03 mm) between adjacent stubs. The present invention provides for installation of a wide range of these fastener assemblages.

The feed member of the invention may be employed with a variety of known actuating mechanisms. What is required is a frame for supporting the elements, a plunger for ejecting the fasteners, and means for reciprocating the feed member. U.S. Pat. Nos. 4,416,407 and 4,651,913 provide such an apparatus, which includes a frame, a trigger, an ejector rod or plunger, an actuator lever, and an actuator slide. The apparatus of the invention differs from the prior art apparatus in the nature of feed member 200, as well as in the linkage between the actuator slide 19 and the feed member, which in the present invention undergoes a reciprocating motion as opposed to the pivoting motion of the feed member of U.S. Pat. No. 4,651,913. It should be understood that a variety of mechanisms can be employed in combination with the elements of the invention, as will be understood from the description below. For the purpose of the following discussion, with reference to FIG. 1, front is indicated by the arrow "F"; rear or backward by arrow "R"; up by arrow "U"; and down by arrow "D".

Figure 3:
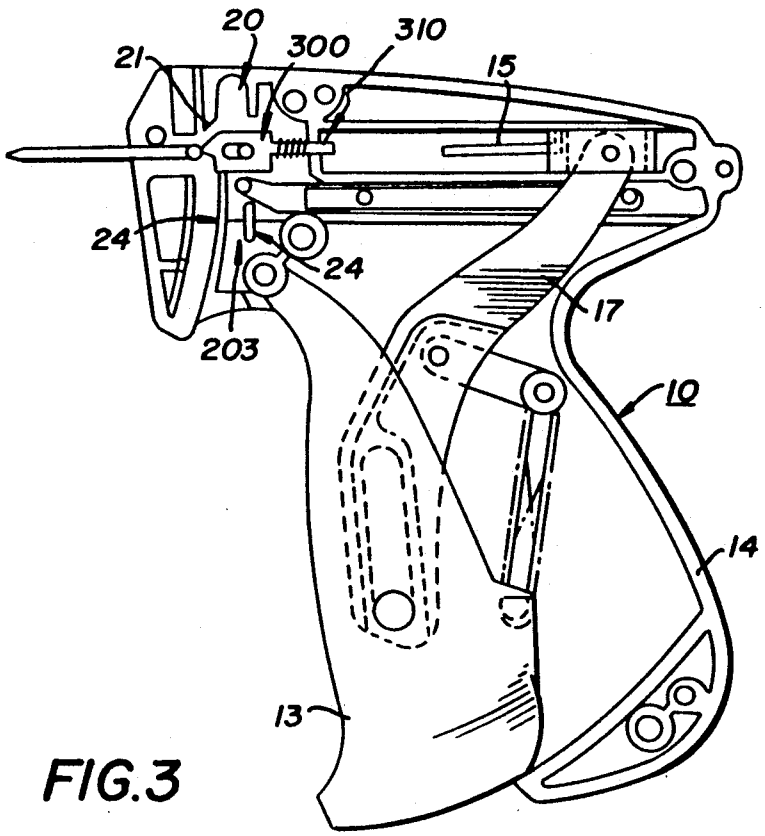
FIG. 3 is the sectional view of FIG. 2, with the feed member removed to more clearly show the location member.
Figure 2:
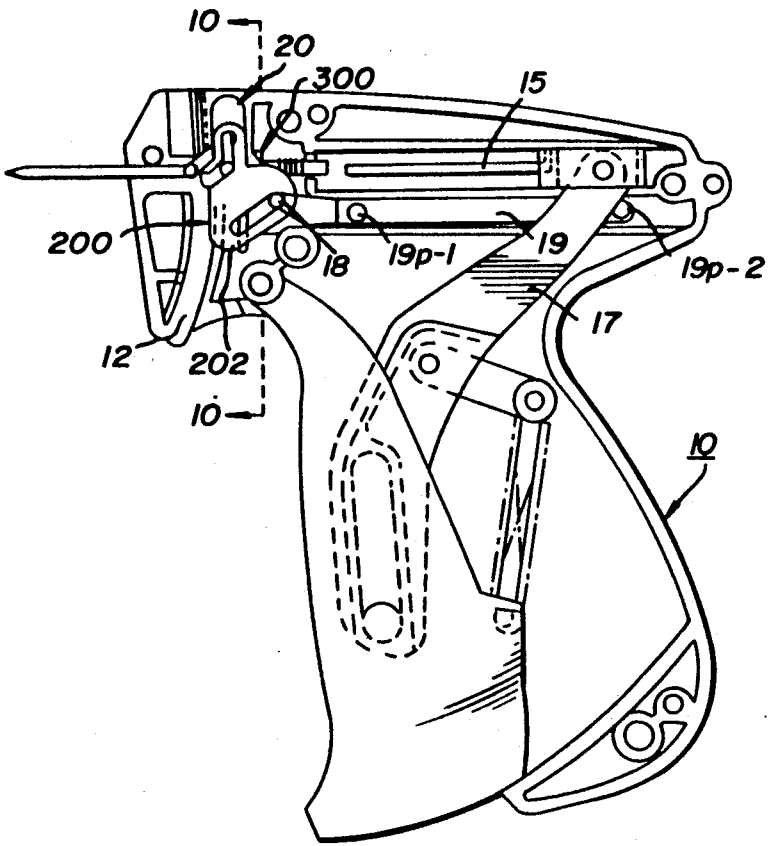
FIG. 2 is a sectional view of a fastener installation apparatus in accordance with the invention, showing the feed member and related structures.
Figure 5A:
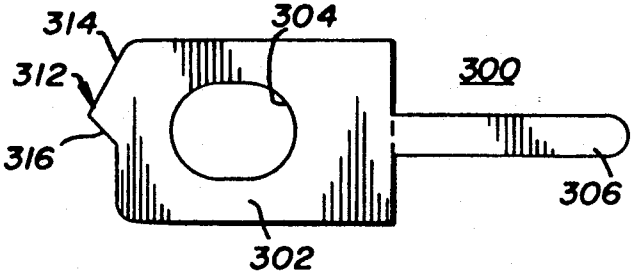
FIGS. 5a, 5b and 5c are front, side, and end views of a preferred location member in accordance with U.S. Pat. No. 4,651,913.
Figure 5B:
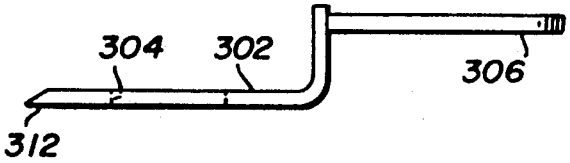
Figure 5C:
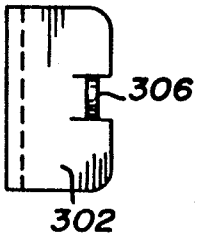
Figure 8:
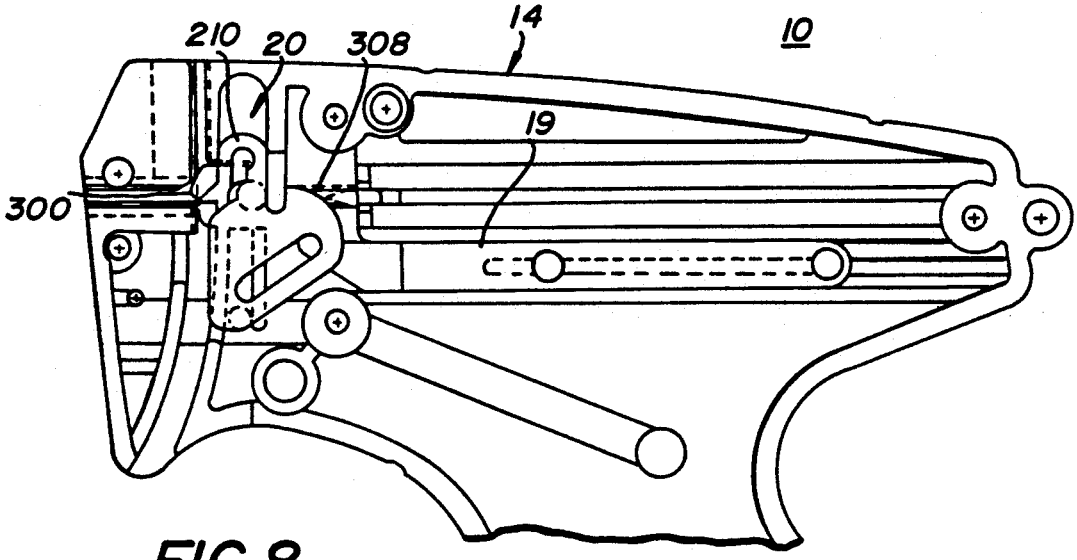
FIG. 8 is a partial sectional view of the installation apparatus of FIG. 2, showing the feed member in its forward (lowermost) position.
Figure 9:
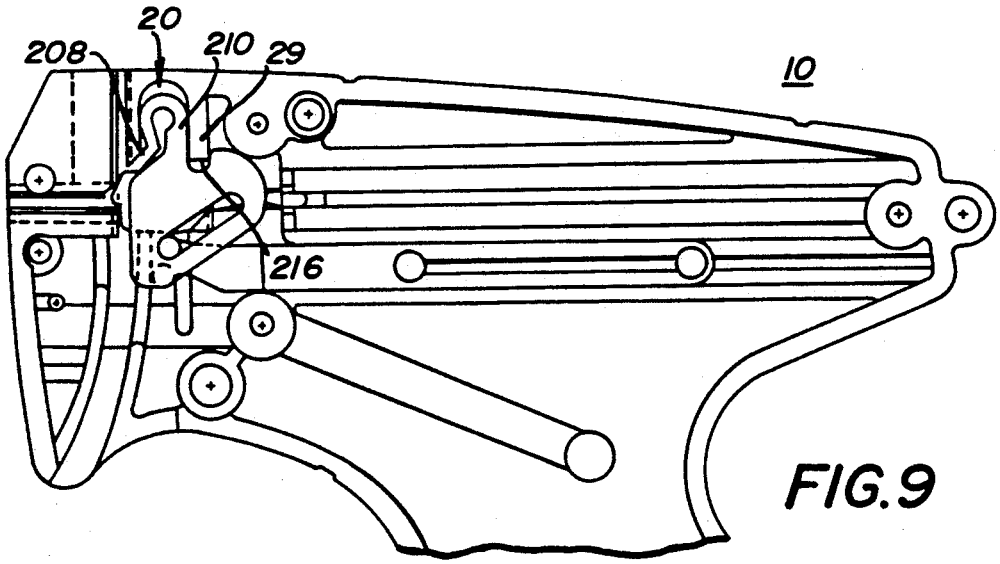
FIG. 9 is a partial sectional view corresponding to FIG. 8, showing the feed member in its retracted (uppermost) position.

With reference to FIGS. 2, 4a-4c a preferred embodiment of the invention includes a feed member 200, comprising a body 205 integral with a guide pin 202 and a resilient finger 210 having a tooth 208. Body 205 includes an angled cam slot 207. Feed member 200 is preferably fabricated from a resilient wear-resistant material, such as NYLON or an acetal resin. Guide pin 202 is received within a vertically oriented channel 203 defined by ribs 24 within the frame in the illustrated embodiment (cf. FIG. 3); alternatively, the frame may be provided with a pin matable with a slot in feed member 200. In either case, the feed member 200 is mounted to reciprocate in directions "U" and "D". As seen in FIGS. 2, 8 and 9, cam slot 207 slidingly engages a rod 18 at one end of actuator slide 19. FIG. 7 gives a side view of slide 19 showing rod 18 as well as posts 19p-1, 19p-2.

Resilient finger 210 has a generally "U"-shaped profile, and is integrally formed from the feed member body 205. Other retroflex shapes of feed finger 210 (i.e., shapes wherein the feed finger bends back toward body 205) may also be employed. The frame 14 is provided with a "U" shaped cavity 20, matable with the resilient finger 210. "U"-shaped cavity 20 in frame 14 is preferably configured to closely surround the feed finger 210 when feed member 200 approaches its extreme of its travel in direction "U". As can be seen in FIGS. 4a, 9, a relieved area 216 of feed member 200 provides a clearance region to permit the feed member to complete its upward travel without interference with the wall 29 which partially defines the "U" shaped cavity. Cavity 20 buttresses finger 210 and restrains the tendency of finger 210 to move away from body 205 during its downward (fastener assemblage advancing) motion. Due to the retroflex shape of finger 210, the extent of its flexure in the other direction is limited by the feed member body 205 itself. Advantageously, the dimensions, stiffness and support of the finger 210 are such that the flexure of the finger is substantially confined to the plane of feed member 200. Having reference to FIG. 4a, tooth 208 has an upper surface 212 defining an angle with respect to the axis of the installed fastener assemblage when the feed member is in an advanced position, as shown in FIG. 9. In a preferred embodiment, surface 212 thus defines an angle of 30°–45°, preferably 40°. In this position, the tooth lower surface is approximately perpendicular to the axis of the assemblage. It should be understood, however, that a range of angles may be advantageously employed for surfaces 212 and 214. The bevelled surfaces 415, 418 have been found to reduce the likelihood of jamming or misfiring of fasteners. This is due to the risk that the trailing end of a fastener crossbar 106 (FIG. 1) might "fall" into the slot between the feed member body 205 and the tooth's lower surface; this is particularly likely for the last fastener in a clip. The bevelled surfaces 415 and 418 in effect provide a "bridge" to prevent this from happening.

Advantageously, the frame 14 further includes an inclined cam surface 21 (FIG. 3) which engages the angled upper surface 212 of tooth 208 as feed member 200 approaches its uppermost position, thereby urging the feed finger 210 and tooth 208 in direction "R" (FIG. 1) to an out-of-the-way position as shown in FIG. 9. This permits the operator to fully depress the trigger 13 in order to cause the feed finger and tooth to withdraw from guide groove 12, thereby allowing a fastener assemblage 100 to be removed from fastener apparatus 10 without interference by feed member 200.

Figure 6B:
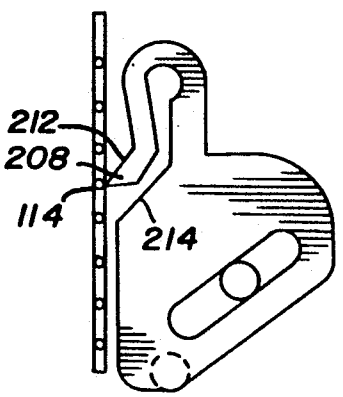
FIGS. 6a, 6b, 6c, and 6d are a schematic of the steps of advancing a fastener assemblage, using the feed member of FIGS. 4a, 4b.
Figure 6C:
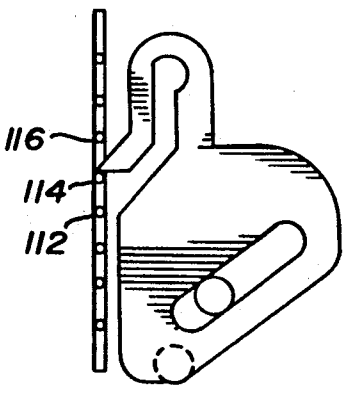
Figure 6D:
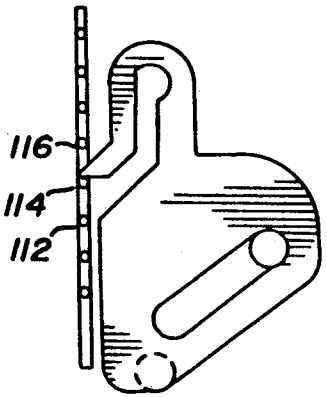
Figure 6A:
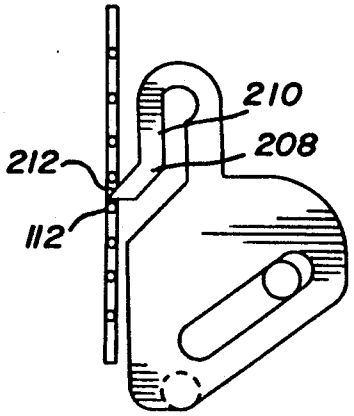

With reference to FIGS. 6a-6d, 8, and 9, the operational steps in advancing the fastener assemblage 100 may now be described. As the user depresses trigger 13, lever 17 (cf. FIG. 2) is pivoted within frame 14 so that its upper end moves in direction "F" thereby driving plunger 15 forward until lever 17 abuts against the post 19p-1 of slide 19 with the forward motion of slide 19. Post 18 moves to the left within cam slot 207 thereby causing the linear upward motion of feed member 200 within apparatus 10. During this part of the cycle of apparatus 10, as shown in FIG. 6a, the tooth 208 of feed member 210 is disposed above a stub 112 which previously was coupled to a fastener which was severed and ejected during the squeezing of trigger 13. With the upward motion of feed member 200, the resilient finger 210 is bent inwardly as tooth 208 is pushed back by the stub 114 (FIG. 6b). Due to the angle of upper surface 212, tooth 208 slides easily over stub 114. As feed member 200 continues in its upward motion, tooth 208 moves in a direction tangential to the direction of fastener assemblage feed, thus causing tooth 208 to become free of stub 114, whereupon finger 210 springs forward disposing tooth 208 between stub 114 and the next succeeding stub 116 (FIG. 6c). With further upward motion of the feed member 200, the upper surface 212 of tooth 208 abuts against the cam surface 21 thereby causing the feed finger 210 and tooth 208 to flex toward the right, as shown in FIG. 9.

Control lever 17 next reverses direction as the trigger 13 is released, and pushes back on post 19p-2 of actuator slide 19. As a result, post 18 is drawn back, sliding within cam slot 207 and inducing the downward linear motion of feed member 200. Lower surface 214 of tooth 208 contacts the upper side of fastener stub 114, and urges the forwardmost fastener connected to the stub into ejecting position as the feed member continues towards its extreme lower position (FIGS. 6d, 8). During this time, the cavity 20 supports feed finger 210 and tooth 208, thus preventing upwards bending of the finger. This cycle is repeated each time the trigger is depressed and released. Because the movement of tooth 208 is tangential to the axis of assemblage 100, clearance of tooth 208 is favored. As a result, a wide range of fasteners pitches may be accommodated.

Feed finger 210 is highly resistant to damage. Due to being integrally formed from the feed member body 205, bending force is distributed over an extended area, as opposed to a particular point. Moreover, great feeding strength is achieved by buttressing the finger with cavity 20.

As shown in the sectioned view of FIG. 10, taken along the section 10—10 in FIG. 2, the feed member 200 is biased against the left half 11 of frame 14 by compression spring 150, which is housed in a post 160 (see also FIGS. 8, 9). A flat surface 11s of frame half 11 acts as a bearing surface for the reciprocating motion of feed member 200. The plunger 15 is slidably supported in the tool half 11 so as to lie against feed member 200.

To prevent the fastener assemblage 100 from moving upwards during cycling of feed member 200, an ejection location member 300 is provided, as shown in FIGS. 3, 5a-5c. A preferred design of location member 300, discussed below, is disclosed in applicant's U.S. Pat. No. 4,651,913. Location member 300 comprises a base 302 having a slot 304, a stem 306 extending from base 302, biasing means 308, a stem guide 310, and a tooth 312.

Location member 300 is positioned beneath feed member 200, wherein post 160 and spring 150 pass through slot 304. Stem guide 310 is formed as a groove in the fastener body, subject to and additionally providing support to plunger 15. Biasing means 308, for example a spring, is mounted on stem 306, confined between guide 310 and body 302. Thus configured, location member 300 is urged in the direction of the installed fastener assemblage 100. The length of slot 304 determines the maximum range over which location member 302 can move. Tooth 312 is provided with an upper surface 314 defining an angle of low elevation, in a preferred embodiment, in the range of 25°-35°, preferably 30° with respect to the axis of location member 302 movement. Tooth 312 lower surface 316, is provided with a higher angle relative to upper surface 314, in a preferred embodiment in the range of 40°-50°, preferably 45° with respect to the axis of location member 302 movement. As disclosed in U.S. Pat. No. 4,651,913, angular surfaces 314, 316 markedly reduce the possibility of jamming or misfiring over a range of fastener geometries.

The present invention thus provides a fastener dispensing apparatus which can reliably advance fastener assemblage of differing pitch. A typical pitch range is between 0.045" and 0.080" (1.14-2.03 mm) (stem center to stem center). However, it should be understood that modifications, particularly to the tooth or finger length, can be made to accommodate pitches outside this range. The invention enables reliable variable pitch feeding with a minimum number of parts.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

What is claimed is:

1. An improved tag attaching apparatus of the type including a frame which mounts a hollow needle at a front end thereof; a guide groove in the frame for routing fasteners in a fastener assembly into alignment with the hollow needle one at a time, said fastener assembly comprising a plurality of individual fasteners coupled to a connecting bar by respective stems; means for feeding the fastener assembly through the guide groove; and detent means for preventing retrograde motion of the fastener assembly, wherein improved feeding means comprises a feed member mounted on said frame to reciprocate alongside the guide groove;

a feed finger integrally hinged to said feed member, comprising a substantially U-shaped member; and a tooth located at a free end of said feed finger and normally disposed in the path of the fastener assembly stems;

wherein in feeding said fastener assembly through the guide groove, the tooth of said feed finger engages a fastener assembly stem, and while moving along a linear path advances the stem past the detent means to move the associated fastener into alignment with the hollow needle.

2. Apparatus as defined in claim 1, further comprising means for supporting and restraining the motion of said feed finger, independent from the feed member.

3. Apparatus as defined in claim 1, wherein the frame defines a cavity for supporting the feed finger.

4. Apparatus as defined in claim 3 wherein the cavity closely surrounds the feed finger at one extreme of the reciprocating motion of said feed member.

5. Apparatus as defined in claim 1, wherein the frame include a camming surface for flexing the feed finger to a position wherein the tooth moves out of the path of the fastener assembly.

6. An improved tag attaching apparatus of the type including a frame which mounts a hollow needle at a front end thereof; a guide groove in the frame for routing fasteners in a fastener assembly into alignment with the hollow needle one at a time, said fastener assembly comprising a plurality of individual fasteners coupled to a connecting bar by respective stems; means for feeding the fastener assembly through the guide groove; and detent means for preventing retrograde motion of the fastener assembly, wherein improved feeding means comprises a feed member mounted in said frame to reciprocate alongside the guide groove;

a feed finger integrally hinged to said feed member, comprising a retroflex member; and a tooth located at a free end of said feed finger and normally disposed in the path of said fastener assembly stems, wherein the tooth flexes toward the feed member in one direction and is restraining in the extent of flexing away from the feed member, and wherein in feeding said fastener assembly through the guide groove, the tooth of said feed finger engages a fastener assembly stem, and while moving along a linear path advances the stem past the detent means to move the associated fastener into alignment with the hollow needle.

7. Apparatus as defined in claim 6 wherein the frame defines a cavity for supporting and restraining the feed finger.

8. Apparatus as defined in claim 7 wherein the cavity closely surrounds the feed finger at one extreme of the reciprocating motion of said feed member.

9. Apparatus as defined in claim 6, wherein the frame includes a camming surface for flexing the feed finger to a position wherein the tooth moves out of the path of the fastener assemblage.

10. An improved tag attaching apparatus of the type including a frame which mount a hollow needle at a front end thereof, a guide groove in the frame for a fastener assembly to route fasteners in such assembly into alignment with the hollow needle one at a time, means for feeding the fastener assembly through the guide groove, and means for preventing retrograde motion of the fastener assembly, wherein improved feeding means comprises a feed member mounted on said frame to reciprocate alongside the guide groove;

a feed finger integrally hinged to said feed member, comprising a substantially U-shaped member; and a tooth located at a free end of said feed finger and normally disposed in the path of the fastener assembly;

wherein the frame defines a cavity for supporting the feed finger, said cavity surrounding the feed finger at one extreme of the reciprocating motion of said feed finger, and said frame further includes a camming surface for flexing the feed finger to a position where the tooth moves out of the path of the fastener assembly stems.

* * * * *